United States Patent [19]

Pickering

[11] Patent Number: 4,836,369

[45] Date of Patent: Jun. 6, 1989

[54] OUT-DOOR FURNITURE AND RECEPTACLE

[75] Inventor: Frank C. Pickering, Derwentside, England

[73] Assignee: SPONS-A-TEE Limited, Durham City, England

[21] Appl. No.: 903,272

[22] Filed: Sep. 3, 1986

[30] Foreign Application Priority Data

Sep. 7, 1985 [GB] United Kingdom ..... 8522251

[51] Int. Cl.[4] ..... B65D 91/00; B65F 1/16

[52] U.S. Cl. ..... 206/216; 40/606; 220/1 T; 297/188; 297/191

[58] Field of Search ..... 206/216; 220/1 T, 83, 220/85 R; 40/584, 612, 606; 297/118, 182, 188, 191, 192, 187, 217

[56] References Cited

U.S. PATENT DOCUMENTS

| | | | |
|---|---|---|---|
| 1,424,519 | 8/1922 | Richardson | 220/83 |
| 1,639,085 | 8/1927 | Fohey | 297/192 |
| 2,961,786 | 11/1960 | Lowmaster | 40/606 |
| 3,057,506 | 10/1962 | Wetlesen | 220/1 T |
| 3,096,900 | 7/1963 | Breneman | 220/85 R |

FOREIGN PATENT DOCUMENTS

| | | | |
|---|---|---|---|
| 3024822 | 1/1982 | Fed. Rep. of Germany | 220/1 T |
| 0619614 | 3/1949 | United Kingdom | 297/188 |

*Primary Examiner*—Jimmy G. Foster

*Attorney, Agent, or Firm*—Rodman & Rodman

[57] ABSTRACT

The outdoor furniture, particularly for location in an out-door setting such as on a golf course or in the countryside, includes a free-standing shell adapted to receive a removable litter container and having a lid attached to said shell, the lid being movable between a first position permitting such a container to be placed within the shell and a second position in which it covers the container, the shell further having an upper surface so positioned as to serve as a support for an adult user. The disclosed embodiment is suitable, among other purposes, for locating adjacent to a tee on a golf course and may incorporate a display panel which may give details of the length and layout of the hole and/or display advertising matter.

3 Claims, 1 Drawing Sheet

OUT-DOOR FURNITURE AND RECEPTACLE

The present invention is a novel piece of furniture, in the broadest sense of the latter word, intended primarily for use in an out-door setting.

It is frequently desirable in assorted out-door locations to provide a litter-bin in order to preserve the tidiness of the surrounding area. Such bins are usually essentially functional in their appearance and may intrude upon their surroundings almost as much as the litter they are designed to contain. Their intrusive presence might be more acceptable if they had some further function to perform but as litter bins alone they tend to be merely tolerated as an unavoidable but necessary presence.

It is an object of the present invention to provide a novel unit of furniture which, as well as serving to hold litter, fulfils at least one further function.

The unit according to the present invention comprises a free-standing shell adapted to receive a removable litter container and having a lid attached to said shell, the lid being movable between a first position permitting said container to be placed within said shell and a second position in which it covers the container, said shell further having an upper surface thereof so positioned as to serve as a support for an adult user.

It is an advantageous characteristic of the unit according to the present invention that it performs two functions which are both important in outdoor settings, especially in such settings which are isolated from surrounding buildings, namely the function of litter bin and resting place. Thus, in for example a countryside location in the region of a footpath, the unit may serve to provide rest for a walker, while at the same time enclosing a receptacle for litter. Similarly, if located at convenient points on a golf course, for example adjacent to one or more tees, the units will contribute to keeping the course tidy and simultaneously offer an opportunity for a golfer to rest.

The unit according to the invention is intended to receive a removable litter container therein. The container may be insertable through an aperture designed to afford access to the container in use or may be insertable through a separate larger aperture, litter then being put into the container via a smaller aperture provided for that purpose. In either case, a lid attached to the shell of the unit, for example pivotted thereto, covers the aperture through which the container is inserted in the shell.

The container may comprise a single compartment but in one form of the present invention it is divided into at least two compartments, each of which may serve a separate purpose. Thus, for example, one such compartment may contain a product to be dispensed therefrom, such as canned or bottled drinks optionally surrounded by ice, while the other compartment is intended still to receive litter, for example empty cans or bottles. One or both of such compartments may be provided with a drain hole to allow waste liquid to run out.

An upper surface of the unit is positioned to provide support for an adult user. That surface may be generally horizontal and at such a height above the ground as to permit an average adult to sit thereon. Alternatively, the surface may be inclined so that an adult user may support himself with his buttocks against the surface and thereby obtain a measure of rest rather less than the total support of sitting. Typically, the support surface may be located of the order of 0.7 to 0.9 metres above the ground.

In a particularly preferred form of the present invention, the shell of the unit has a surface designed to carry an information display. That display surface is preferably separate from the body-supporting surface but may, if desired, be upon the access lid. The information may, in a countryside setting, take the form of a map or other guide to the surroundings. When the unit is located adjacent to a tee on a golf course, the information displayed may give details of the characteristics of the next hole to be played. Thus the display may include details of the length and layout of the hole and also par figures for that hole.

Alternatively, or in addition, the display may include advertising material, in particular advertising products associated with the location of the unit.

As a further feature, the unit may be provided with means for mounting thereon a display above head-height. For example, one or more sockets may be provided to receive poles supporting such an elevated display. A display of this type may be particularly important in a crowded setting, such as on a golf course when a tournament is in progress. In such a setting, the elevated display may simply be a land-mark indicating the position of the tee or may carry such information as described above.

The invention will now be further described with reference to the accompanying drawings, which illustrate, by way of example, one embodiment of the unit according to the invention. In the drawings.

Figure 1:
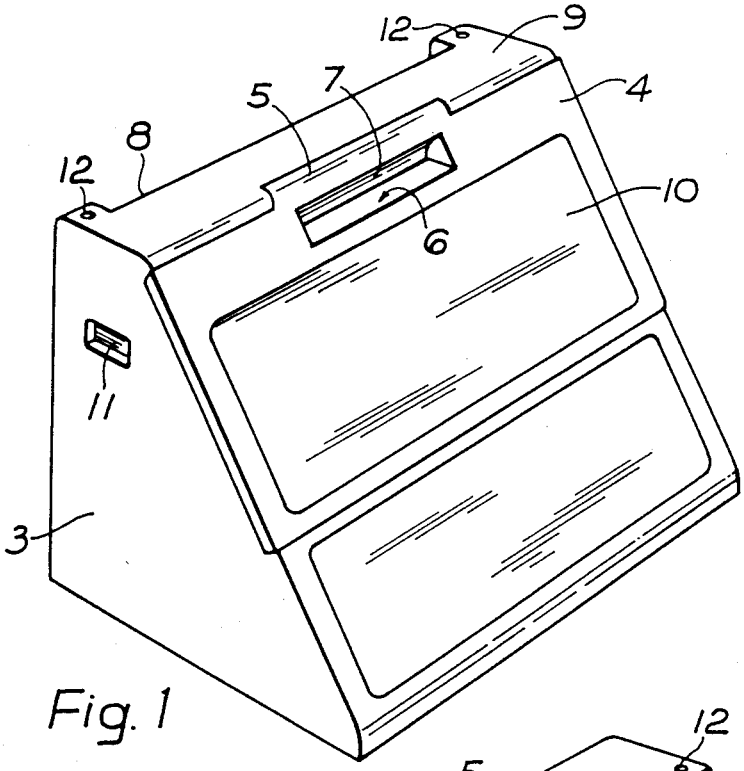
FIG. 1 is a perspective view from the front.
Figure 2:
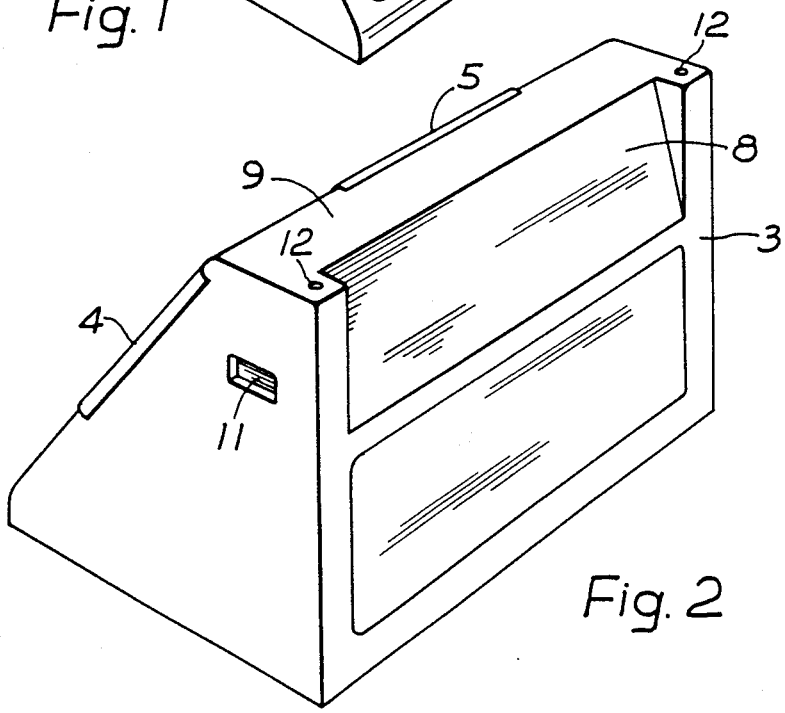
FIG. 2 is a perspective view from the rear of the unit.

The illustrated unit is moulded in just two pieces from glass-reinforced plastics material. The unit comprises a shell 3 and a lid 4 hinged thereto at 5. The lid 4 affords access to the interior of the shell to permit the insertion therein of a container (not shown) having two compartments separated by a vertical partition. Within the lid 4 is an elongated aperture 6 for the insertion of litter. The aperture 6 is shielded by a curved back-plate 7 integrally formed with the lid 4.

At the rear of the shell 3 there is formed an inclined planar surface 8 which allows an adult to gain some rest and support by leaning against it, optionally sitting upon the flat upper surface 9 of the unit.

Upon a flat panel 10 centrally placed on the lid 4, information of any desired type may be displayed. It is envisaged in particular that the unit may be placed adjacent to a tee on a golf course and that the information may include an outline map of the hole to be played from that tee, together with details of the hole length and par value.

Recesses 11 are moulded in the shell 3 to afford handholds for the unit to be moved into position or to permit course maintenance in its vicinity. By means of apertures 12 in the upper surface 9 of the shell, poles may be erected to support an additional display of course information or advertising material as desired.

When the illustrated unit is located on a golf course, one of the compartments of the container therein may be used to store a mixture of sand and grass-seed, for use when replacing divots dislodged by golfers.

I claim:

1. A furniture unit for outdoor locations, which comprises:

(a) a one-piece shell formed of a synthetic polymeric material, said shell having an interior space;

(b) a substantial first aperture in said shell, through which a litter container may be inserted into the interior space of said shell;

(c) a lid, which is pivoted about an essentially horizontal pivot upon said shell for movement about said pivot between a first position in which said first aperture is exposed to permit insertion of said container through said first aperture, and a second position in which said lid covers said first aperture;

(d) a second aperture, which is substantially smaller than said first aperture and is located in said lid, whereby litter may be placed through said second aperture into said container within said shell when said lid is in said second position;

(e) a first surface, which is at least partly included to the vertical, located within the upper region of said shell at a predetermined height to afford some support to an adult person leaning upon said furniture unit; and (f) a second surface located upon the exterior of said lid, said second surface being generally flat and inclined to the vertical for ready visibility to persons near to said furniture unit, said second surface capable of receiving an information display thereon.

2. A furniture unit according to claim 1, further including at least one socket in an upper, generally horizontal surface of said shell, to support an additional information display at a position remote from and above said upper surface of said shell.

3. A furniture unit according to claim 1, wherein said second surface on the exterior of said lid is capable of carrying a map of a part of a golf course as the information display thereon.

* * * * *

UNITED STATES PATENT AND TRADEMARK OFFICE

CERTIFICATE OF CORRECTION

PATENT NO. : 4,836,369

DATED : June 6, 1989

INVENTOR(S) : Frank C. Pickering

It is certified that error appears in the above-identified patent and that said Letters Patent is hereby corrected as shown below:

At column 3, line 15, change "included" to --inclined--.

Signed and Sealed this

Thirteenth Day of February, 1990

*Attest:*

JEFFREY M. SAMUELS

*Attesting Officer*

*Acting Commissioner of Patents and Trademarks*